US010659884B2

(12) United States Patent
Cao et al.

(10) Patent No.: US 10,659,884 B2
(45) Date of Patent: May 19, 2020

(54) SPEAKER

(71) Applicant: AAC Technologies Pte. Ltd., Singapore (SG)

(72) Inventors: Chengming Cao, Shenzhen (CN); Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/233,492

(22) Filed: Dec. 27, 2018

(65) Prior Publication Data

US 2019/0215612 A1 Jul. 11, 2019

(30) Foreign Application Priority Data

Jan. 5, 2018 (CN) ..... 2018 1 0011862

(51) Int. Cl.

| | |
|---|---|
| ***H04R 1/28*** | (2006.01) |
| ***H04R 7/12*** | (2006.01) |
| ***H04R 9/06*** | (2006.01) |
| ***H04R 9/02*** | (2006.01) |
| ***H04R 9/04*** | (2006.01) |
| ***H04R 7/02*** | (2006.01) |
| ***H04R 1/02*** | (2006.01) |
| ***H04R 31/00*** | (2006.01) |
| ***H04R 7/18*** | (2006.01) |
| *H04R 1/44* | (2006.01) |

(52) U.S. Cl.

CPC ..... *H04R 9/06* (2013.01); *H04R 1/02* (2013.01); *H04R 7/02* (2013.01); *H04R 7/18* (2013.01); *H04R 9/025* (2013.01); *H04R 9/04* (2013.01); *H04R 31/003* (2013.01); *H04R 1/44* (2013.01); *H04R 2209/024* (2013.01); *H04R 2209/027* (2013.01); *H04R 2400/11* (2013.01); *H04R 2499/11* (2013.01)

(58) Field of Classification Search

USPC ..... 381/345, 430

See application file for complete search history.

(56) References Cited

U.S. PATENT DOCUMENTS

2008/0031481 A1* 2/2008 Warren ..... H04R 1/1016 381/322

2008/0166004 A1* 7/2008 Sanford ..... H01Q 1/243 381/375

* cited by examiner

*Primary Examiner* — Suhan Ni

(74) *Attorney, Agent, or Firm* — IPro, PLLC; Na Xu

(57) ABSTRACT

The present disclosure provides a speaker, including a frame, a magnetic circuit system and a vibration system accommodated in the frame; the frame includes a main body defining an accommodating space and a mounting portion extending from the main body toward the vibrating diaphragm; the vibrating diaphragm is fixed at the mounting portion; the main body and the mounting portion are integrally formed through double-shot molding by using two kinds of plastics, where the main body is made of PPA, and the mounting portion is made of LCP. According to the speaker provided in the present disclosure, a glued surface between the vibrating diaphragm and the mounting portion has good flatness, which helps to improve waterproof performance and performance yield of the speaker, and firmness of gluing the magnetic circuit system with the main body is high, which helps to improve reliability of the product when the product falls.

6 Claims, 4 Drawing Sheets

SPEAKER

CROSS-REFERENCE TO RELATED APPLICATIONS

This application claims the priority benefit of Chinese Patent Application Ser. No. 201810011862.2 filed on Jan. 5, 2018, the entire content of which is incorporated herein by reference.

TECHNICAL FIELD

The present disclosure relates to the field of electroacoustic conversion, and in particular, to a speaker.

BACKGROUND

The coming of the era of mobile Internet leads to an increase in the number of smart mobile devices. In numerous mobile devices, mobile phones are undoubtedly most common and most portable mobile terminal devices. Currently, a mobile phone has extremely various functions, one of which is a high-quality music playing function, and a speaker in the mobile phone is one of essential conditions for realizing the high-quality music playing function.

A speaker in the related art includes a frame, a magnetic circuit system and a vibration system accommodated in the frame, and a front cover covering the frame. The vibration system includes a vibrating diaphragm sandwiched between the frame and the front cover, and the vibrating diaphragm is connected to a surface of the frame through gluing. However, the frame in the related art is generally made of PPA. The frame made of PPA has relatively poor flatness and poor flowability. When the vibrating diaphragm is glued to the frame, sealing performance is poor, affecting waterproof performance of the entire speaker and performance yield of a product.

Therefore, it is necessary to provide an improved speaker to resolve the foregoing problem.

BRIEF DESCRIPTION OF THE DRAWINGS

To describe the technical solutions in the embodiments of the present disclosure more clearly, the following briefly describes the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION

The following clearly and completely describes the technical solutions in the embodiments of the present disclosure with reference to the accompanying drawings in the embodiments of the present disclosure. Apparently, the described embodiments are merely some but not all of the embodiments of the present disclosure. All other embodiments obtained by a person of ordinary skill in the art based on the embodiments of the present disclosure without creative efforts shall fall within the protection scope of the present disclosure.

Figure 1:
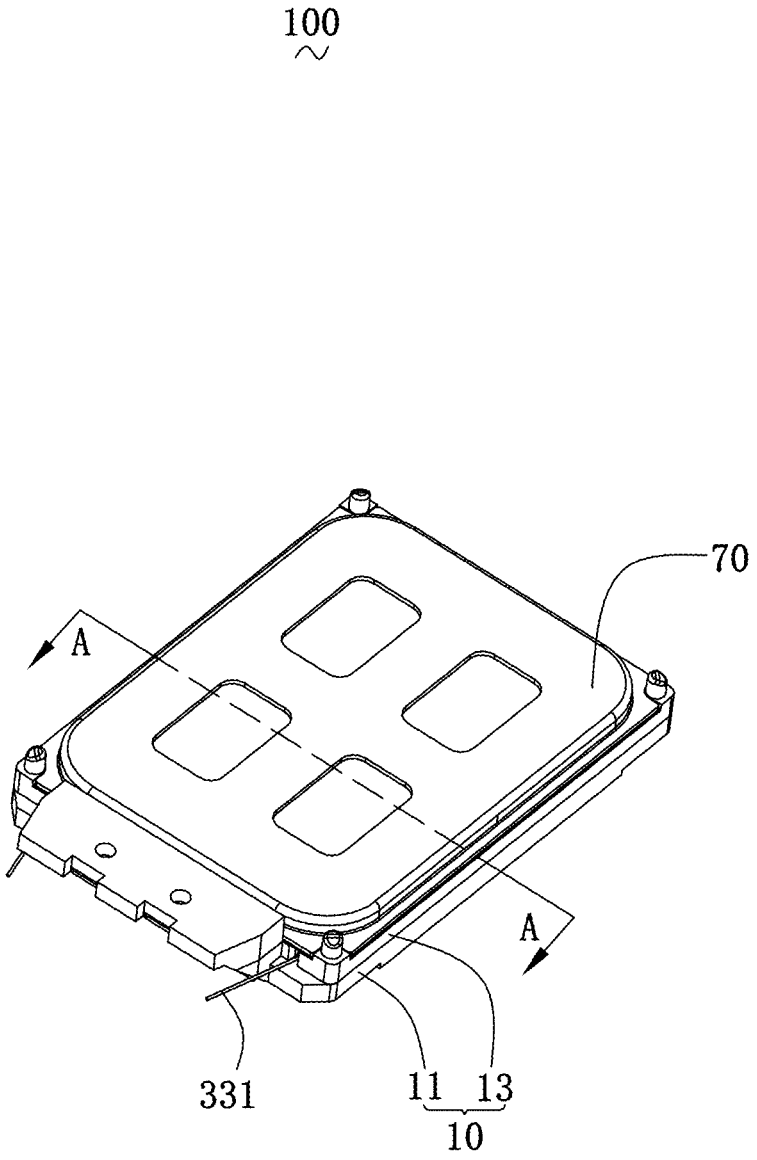
FIG. 1 is a schematic three-dimensional structural diagram of a speaker according to the present disclosure.
Figure 2:
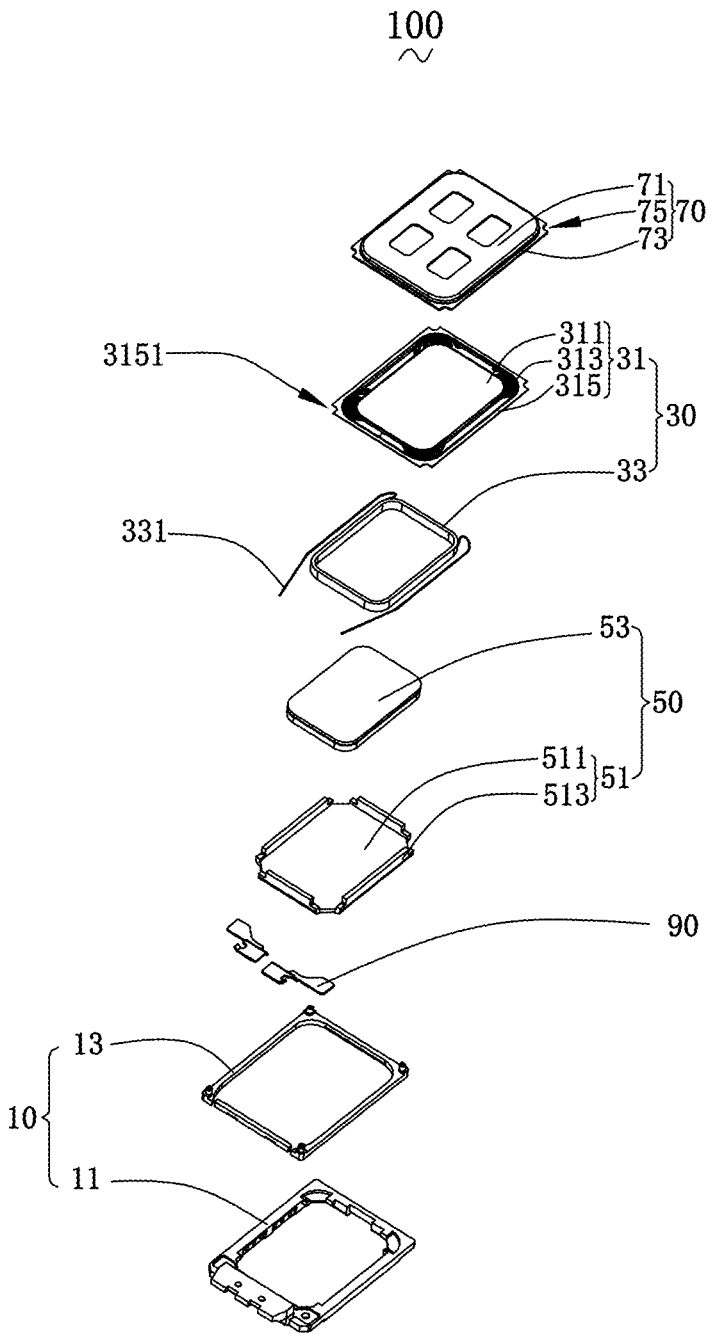
FIG. 2 is a schematic exploded view of a structure of a speaker according to the present disclosure.
Figure 3:
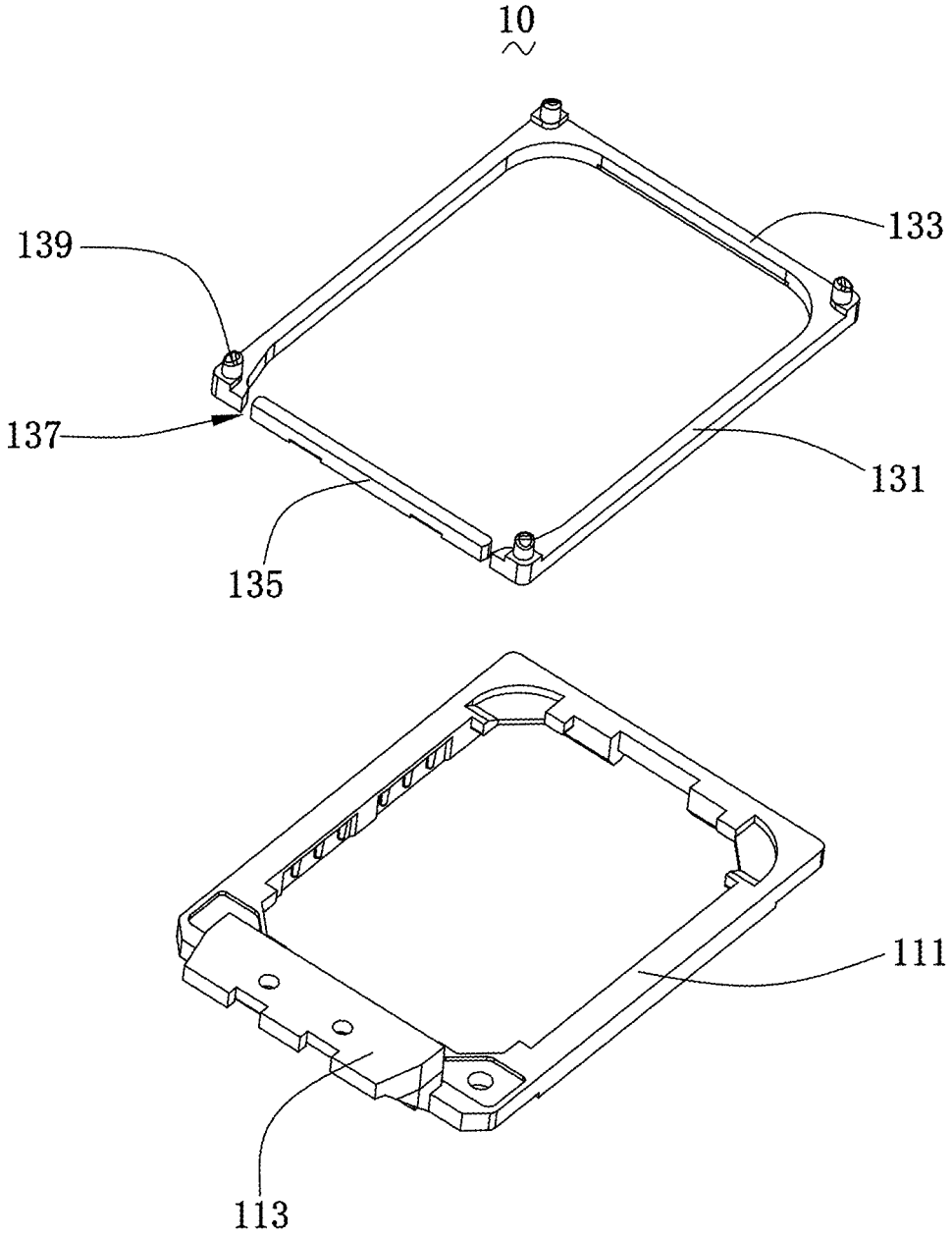
FIG. 3 is a schematic exploded view of a structure of a frame of the speaker shown in FIG. 1.
Figure 4:
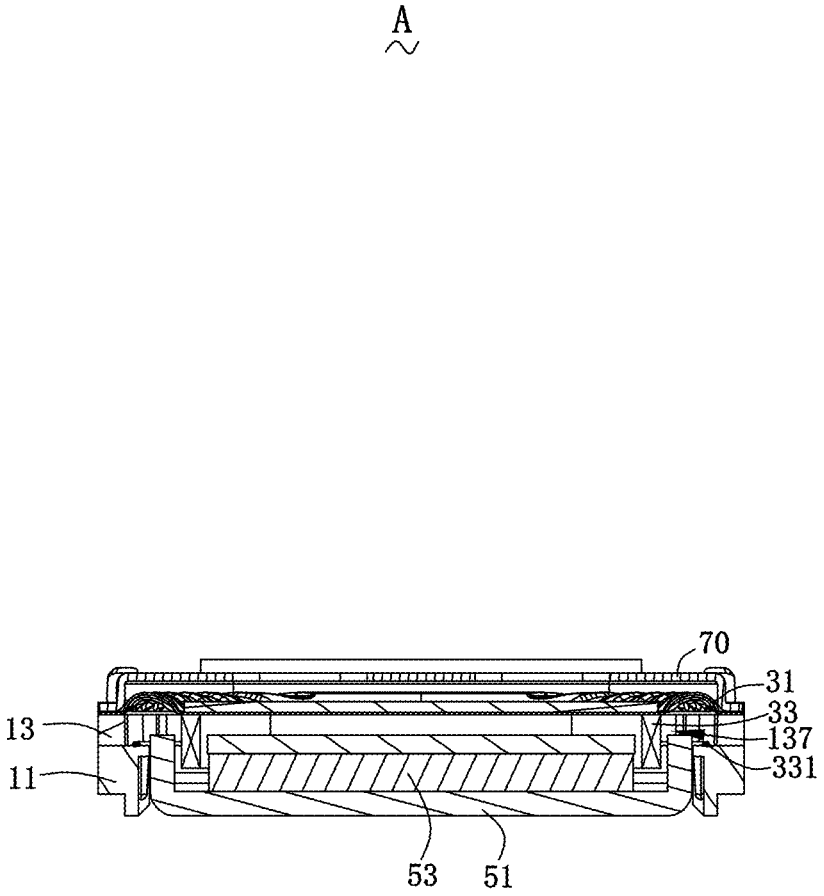
FIG. 4 is a schematic structural diagram of a cross section along a line A-A shown in FIG. 1.

Referring to FIG. 1 to FIG. 4, the present disclosure provides a speaker 100. The speaker 100 includes a frame 10, a vibration system 30 and a magnetic circuit system 50 disposed in the frame 10, a front cover 70 covering the frame 10, and a conductive terminal 90 embedded into the frame 10. The magnetic circuit system 50 is configured to drive the vibration system 30 to vibrate to produce a sound.

The frame 10 includes a main body 11 defining an accommodating space and a mounting portion 13 extending from the main body 11 toward the front cover 70. The magnetic circuit system 50 is accommodated in the main body 11 and fixedly connected to the main body 11. A vibrating diaphragm of the vibration system 30 is fixedly connected to the mounting portion 13. The main body 11 and the mounting portion 13 are integrally formed through double-shot molding by using two kinds of plastics, where the main body is made of PPA, and the mounting portion is made of LCP. The PPA material has a high adhesive strength with glue. Therefore, when the magnetic circuit system 50 is connected to the main body 11 by using glue, gluing firmness is high, and good reliability is obtained when the product accidentally falls. The LCP material is easy to mold, and has good flatness for a glued surface. When the vibrating diaphragm of the vibration system 30 is connected to the mounting portion 13 through gluing, bonding is achieved, providing higher sealing performance, higher waterproof and dustproof performance, and higher acoustic performance.

The main body 11 includes a frame body 111 defining the accommodating space and an extension portion 113 extending from one end of the frame body 111 toward a direction away from the accommodating space. The frame body 111 is of a rectangular ring shape.

The mounting portion 13 includes a pair of long shaft portions 131 that are disposed in parallel and at intervals, and a first short shaft portion 133 and a second short shaft portion 135 that are respectively connected to two ends of each of the two long shaft portions 131, two notches 137 provided at two ends of the second short shaft portion 135 and running through the second short shaft portion 135, and positioning posts 139 disposed at corners at which the long shaft portion 131 is connected to the first short shaft portion 133 and the second short shaft portion 135. The second short shaft portion 135 is connected to the extension portion 113. The two long shaft portions 131, the first short shaft portions 133, the second short shaft portions 135, and the two notches 137 together form a rectangular ring.

The vibration system 30 includes a vibrating diaphragm 31 sandwiched between the mounting portion 13 and the front cover 70, and a voice coil 33 of which one end is secured to the vibrating diaphragm 31 and that is configured to drive the vibrating diaphragm 31 to vibrate to produce a sound.

The vibrating diaphragm 31 includes a dome portion 311 located in the middle, an edge portion 313 extending along an outer periphery of the dome portion 311, and a fixing portion 315 extending along an outer periphery of the edge portion 313. The fixing portion 315 is sandwiched between the mounting portion 13 and the front cover 70. Corresponding to positions of the positioning posts 139, the fixing portion 315 is provided with a vibrating diaphragm avoiding portion 3151.

The fixing portion 315 is connected, through gluing, to a side surface of the mounting portion 13 away from the main body 11. Because the mounting portion 13 is made of the LCP material, the mounting portion 13 has good flatness. Therefore, when the vibrating diaphragm 31 is fixed to the mounting portion 13, good sealing performance is obtained, thereby helping improving waterproof performance and performance yield of the product.

The voice coil 33 includes a pair of voice coil lead wires 331. The two voice coil lead wires 331 extend out of the frame 10 though the two notches 137.

The magnetic circuit system 50 is assembled inside the main body 11. The magnetic circuit system 50 includes a magnetic yoke 51 fixedly connected to the main body 11 and a magnet 53 assembled to the magnetic yoke 51 to form a magnet gap.

The magnetic yoke 51 includes a bottom wall 511 and side walls 513 bending and extending from the bottom wall 511. The side walls 513 and the magnet 53 form the magnet gap, and the voice coil 33 is inserted into the magnet gap. There are four side walls 513 which are not mutually connected. The magnet 53 is fixed onto the bottom wall 511. The side walls 513 and the frame body 111 are fixed by using glue. Because the frame body 111 is made of the PPA material, and has adhesiveness to the glue, gluing firmness between the magnetic yoke 51 and the main body 11 is high. Therefore, good reliability is obtained when the product accidentally falls.

The front cover 70 is disposed on a side of the vibrating diaphragm 31 that is away from the mounting portion 13, and is fixedly connected to the vibrating diaphragm 31. The front cover 70 includes a center portion 71 covering the dome portion 311 and the edge portion 313, a rim portion 73 bending and extending from an outer periphery of the center portion 71 toward the vibrating diaphragm 31, and front cover avoiding portions 75 disposed at the rim portion 73. The front cover avoiding portions 75 are disposed corresponding to the position of the positioning posts 139. The fixing portion 315 is sandwiched between the mounting portion 13 and the rim portion 73, and the rim portion 73 and the fixing portion 315 are connected through gluing.

The conductive terminal 90 is configured to electrically connect to the outside. There are two conductive terminals 90. One end of the conductive terminal 90 is embedded into the extension portion 113, and the other end is embedded into the short shaft portion of the frame body 111 connected to the extension portion 113.

Beneficial effects of the speaker 100 in the present disclosure are as follows:

The main body 11 and the mounting portion 13 are integrally formed through double-shot molding, having good sealing performance. The mounting portion 13 is made of LCP. A glued surface has good flatness when the vibrating diaphragm 31 and the mounting portion 13 are connected through gluing. Better bonding is achieved, providing higher sealing performance, higher waterproof and dustproof performance, and higher acoustic performance. The main body 11 is made of PPA. When the main body 11 and the magnetic circuit system 50 are fixed by gluing, gluing firmness is high, and stability is good, so that the magnetic circuit system 50 is not prone to loosening when the product accidentally falls.

The above descriptions are merely implementations of the present disclosure. It should be noted herein that a person of ordinary skill in the art may make improvements without departing from the creative ideas of the present disclosure, and all these improvements shall fall within the protection scope of the present disclosure.

What is claimed is:

1. A speaker, comprising a frame, and a magnetic circuit system and a vibration system accommodated in the frame, wherein the vibration system comprises a vibrating diaphragm fixed at one end of the frame and a voice coil connected to the vibrating diaphragm; the frame comprises a main body defining an accommodating space and a mounting portion extending from the main body toward the vibrating diaphragm; the vibrating diaphragm is fixed at the mounting portion; the magnetic circuit system is accommodated in the main body and fixedly connected to the main body; and the main body and the mounting portion are integrally formed through double-shot molding by using two kinds of plastics, wherein the main body is made of PPA, and the mounting portion is made of LCP; the main body comprises a frame body defining the accommodating space and an extension portion extending from one end of the frame body toward a direction away from the accommodating space; the mounting portion comprises a pair of long shaft portions that are disposed in parallel and at intervals, and a first short shaft portion and a second short shaft portion that are respectively connected to two ends of each of the two long shaft portions, wherein the second short shaft portion is connected to the extension portion and is provided with a notch running through the second short shaft portion, and a lead wire of the voice coil extends out of the accommodating space through the notch.

2. The speaker according to claim 1, wherein the frame body is of a rectangular ring structure.

3. The speaker according to claim 2, wherein the magnetic circuit system comprises a magnetic yoke and a magnet assembled to the magnetic yoke, the magnetic yoke comprises a bottom wall and a side wall bending and extending from the bottom wall, the magnet is fixed onto the bottom wall, the magnet is spaced apart from the side wall to form a magnet gap, the voice coil is inserted into the magnet gap, and the side wall is connected to the frame body through gluing.

4. The speaker according to claim 1, wherein the vibrating diaphragm comprises a dome portion located in the middle, an edge portion extending along an outer periphery of the dome portion, and a fixing portion extending along an outer periphery of the edge portion, and the fixing portion is connected, through gluing, to a side surface of the mounting portion away from the main body.

5. The speaker according to claim 1, wherein the mounting portion further comprises positioning posts disposed at corners at which the long shaft portion is connected to the first short shaft portion and the second short shaft portion, and corresponding to positions of the positioning posts, the speaker further comprises a front cover covering the frame, the vibrating diaphragm and the front cover are respectively provided with a vibrating diaphragm avoiding portion and a front cover avoiding portion.

6. The speaker according to claim 5, wherein the vibrating diaphragm is sandwiched between the mounting portion and the front cover.

* * * * *